US005836118A

United States Patent [19]

Thornton et al.

[11] Patent Number: 5,836,118

[45] Date of Patent: Nov. 17, 1998

[54] DOOR JAMB SYSTEM WITH PROTECTIVE STOP AND JAMB CLADDING

[75] Inventors: James D. Thornton, St. Charles, Ill.; Philip A. Wortman, Prineville, Oreg.; Larry J. Schlicht, New Albany, Ill.

[73] Assignee: The Standard Products Company, Cleveland, Ohio

[21] Appl. No.: 700,005

[22] Filed: Aug. 20, 1996

[51] Int. Cl.[6] ..... E06B 1/04

[52] U.S. Cl. ..... 52/204.1; 52/211; 52/212; 52/213; 52/217; 49/505; 49/504

[58] Field of Search ..... 52/204.1, 211, 52/212, 213, 217; 49/505, 504, DIG. 1

[56] References Cited

U.S. PATENT DOCUMENTS

| | | | |
|---|---|---|---|
| 2,616,531 | 11/1952 | Young | 52/211 |
| 2,736,930 | 3/1956 | Longley . | |
| 3,040,390 | 6/1962 | Carlton . | |
| 3,119,156 | 1/1964 | Salter, Jr. . | |
| 3,245,124 | 4/1966 | Faske . | |
| 3,402,520 | 9/1968 | Lee et al. . | |
| 3,570,202 | 3/1971 | Castellano . | |
| 3,609,928 | 10/1971 | Mock | 52/211 X |
| 3,729,870 | 5/1973 | Kvalheim et al. . | |
| 4,005,558 | 2/1977 | Barrison | 52/213 |
| 4,281,481 | 8/1981 | Wendt . | |
| 4,439,965 | 4/1984 | Langenhorst | 52/211 |
| 4,492,063 | 1/1985 | Schock et al. . | |
| 4,505,080 | 3/1985 | Sailor . | |
| 4,614,068 | 9/1986 | Bergthold | 52/211 |
| 4,720,951 | 1/1988 | Thorn et al. . | |
| 4,993,764 | 2/1991 | Barker | 52/217 X |
| 5,070,651 | 12/1991 | Jeter | 49/505 |
| 5,634,303 | 6/1997 | Ellingson . | |

FOREIGN PATENT DOCUMENTS

| | | |
|---|---|---|
| 1 946 996 | 3/1971 | Germany . |
| 24 36 055 | 2/1976 | Germany . |
| 34 42 476 | 7/1985 | Germany . |
| 2 214 214 | 8/1989 | United Kingdom . |

*Primary Examiner*—Carl D. Friedman
*Assistant Examiner*—W. Glen Edwards
*Attorney, Agent, or Firm*—Harness, Dickey & Pierce, P.L.C.

[57] ABSTRACT

A protective door jamb system integrally connected to a door frame. The door jamb system of the present invention includes both a door stop and jamb cladding each manufactured from an extruded plastic product such as hollow rigid plastic, cellular plastic, granular filled plastic or fiber filled plastic. The door stop and jamb clad are each designed to attach to a door jamb substrate through compression deflected fingers. The door jamb system of the present invention may also include a weather strip to ensure a weather-tight seal of a door when the door is closed into the frame. The jamb clad of the present invention covers the recessed portion of the door jamb substrate adjacent the jamb to completely cover the substrate and thereby increase both the structural and aesthetic integrity of the frame. The door jamb system of the present invention therefore permits use of otherwise aesthetically unpleasing, and less expensive material, for the door jamb substrate, with the advantage being that a high quality product may be manufactured for less associated cost.

20 Claims, 3 Drawing Sheets

DOOR JAMB SYSTEM WITH PROTECTIVE STOP AND JAMB CLADDING

BACKGROUND OF THE INVENTION

The present invention relates generally to door frames used in a building, and more particularly to a door jamb system that increases both the aesthetic and structural integrity of a door frame and reduces maintenance requirements.

A conventional exterior door frame typically includes a door jamb system. The door jamb system provides a weather-tight seal between the interior and exterior of a building when a door attached thereto is shut within the frame. The jamb system includes side jambs which are located along the inner peripheral vertical edges of the frame and abut the side edges of the door when the door is shut within the frame. A head jamb is located along the top inner periphery of the door frame and abuts the top edge of the door when the door is shut into the frame. The side and head jambs also typically include some form of weather strip to prevent air and other outdoor elements from entering the building interior when the door abuts the side and head jambs. In addition to providing the weather-tight seal, the side and head jambs prevent the door from swinging through the frame.

Because an exterior door frame acts as an interface between the building interior and exterior, the associated jamb system is continually exposed to harsh conditions, such as moisture, sunlight and temperature extremes, which typically cause damage to and decrease the useful life of the jamb system. Therefore, conventional system components must be protected from such conditions to ensure structural longevity.

Several approaches have been used in the past to protect jamb system components. In a traditional approach, wood-based door jambs are covered with paint, varnish or other wet applied protective coatings. However, such wood-based preservative systems require periodic reapplication and typically only provide marginal protection to the jamb.

In another approach, film or laminent coverings are applied over wood-based door jambs and bonded thereto with adhesives. However, such adhesives often become detached from the jambs due to such conditions as moisture seepage and thermal bow caused by extreme temperature conditions.

In yet another approach, to overcome the above-mentioned problems associated with wood-based door jamb systems, door jamb systems manufactured from solid cellular plastic material, hollow rigid plastic materials or composite materials have been produced. Door jamb systems made from such materials do not require the periodic reapplication of wet applied protective coverings, nor do such plastic-based systems require any type of protective covering. However, door jambs made from such synthetic materials often lack the structural integrity of wood-based door jambs. In addition, such systems are typically vulnerable to thermal bow and thermal expansion and contraction. As a result, doors mounted within frames having such jamb systems typically do not fit in a weather-tight manner once the jamb system has been subjected to such conditions.

In another approach, door jamb clads manufactured from steel, aluminum or plastic have been used in the past to cover portions of wood-based door frames to protect the door frames from exposure to extreme weather conditions. However, a typical door jamb clad covers only a part of the door frame, thereby requiring a high quality substrate, such as wood, to be used as the frame itself to maintain both the structural and aesthetic integrity of the frame. Further, such door jamb clads typically require a time consuming installation procedure, thereby increasing the associated cost of the door frame system.

Therefore, it would be desirable to provide a door frame having a clad/jamb system that is integrally attached to the door frame to enhance both the structural and aesthetic qualities of the door frame and to permit the frame to be constructed of a material less expensive than high quality wood while maintaining frame structural integrity. It would also be desirable to provide a door frame having a clad/jamb system that makes the frame less susceptible to changes caused by exposure to extreme weather conditions and thereby increases the overall life of the frame.

SUMMARY OF THE INVENTION

In accordance with the above-described needs, the present invention provides a door frame having a protective door-jamb system integrally connected to the door frame. Through implementation of the door jamb system of the present invention, a door jamb substrate may be manufactured from a composite material such as oriented strand board, chip board, plywood, fiber board, or other lower quality wood board products, as well as any of the more commonly used, and more expensive wood, plastic or metal-based products.

The door jamb system of the present invention includes both a door stop and jamb cladding each manufactured from an extruded plastic product such as hollow rigid plastic, cellular plastic, granular filled plastic or fiber filled plastic. The door stop and jamb clad are each designed to attach to a door jamb substrate through compression deflected fingers. The door jamb system of the present invention may also include a weather strip to ensure a weather-tight seal of a door when the door is closed into the frame. The jamb clad of the present invention covers the recessed portion of the door jamb substrate adjacent the jamb to completely cover the substrate and thereby increase both the structural and aesthetic integrity of the frame. The door jamb system of the present invention therefore permits use of otherwise aesthetically unpleasing, and less expensive material, for the door jamb substrate, with the advantage being that a high quality product may be manufactured for less associated cost.

Therefore, it is an object of the present invention to provide a door frame having a clad/jamb system that is integrally attached to the door frame to protect the door frame from extreme weather conditions.

It is a further object of the present invention to provide a door frame having a clad/jamb system that allows the door frame to be constructed from a relatively inexpensive substrate having less aesthetically pleasing qualities than conventional door jamb systems without sacrificing door frame structural integrity.

It is a further object of the present invention to provide a door frame having a clad/jamb system that enhances both the structural and aesthetic qualities of the door frame itself.

It is yet another object of the present invention to provide a door frame having a clad/jamb system having minimal assembly and maintenance requirements.

It is a further object of the present invention to provide a door clad/jamb system that mechanically interlocks with a door frame substrate to increase the overall structural integrity of the door frame itself.

These and other various advantages and features of the present invention will become apparent from the following description and claims, in conjunction with the appended drawings.

DETAILED DESCRIPTION OF THE PREFERRED EMBODIMENTS

Figure 1:
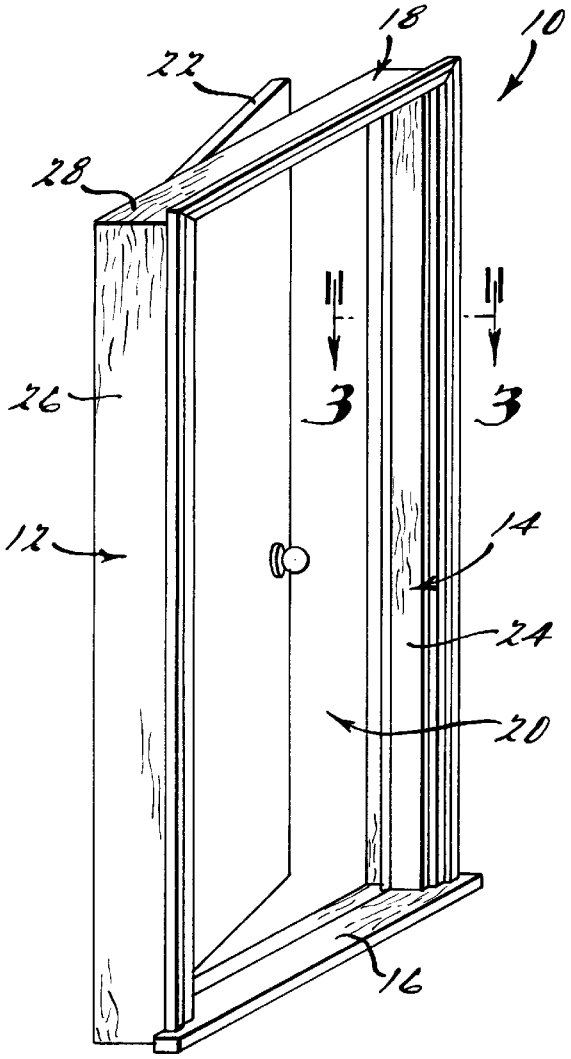
FIG. 1 is a front perspective view of an exterior door frame in which a door jamb system according to a preferred embodiment of the present invention is implemented.
Figure 2:
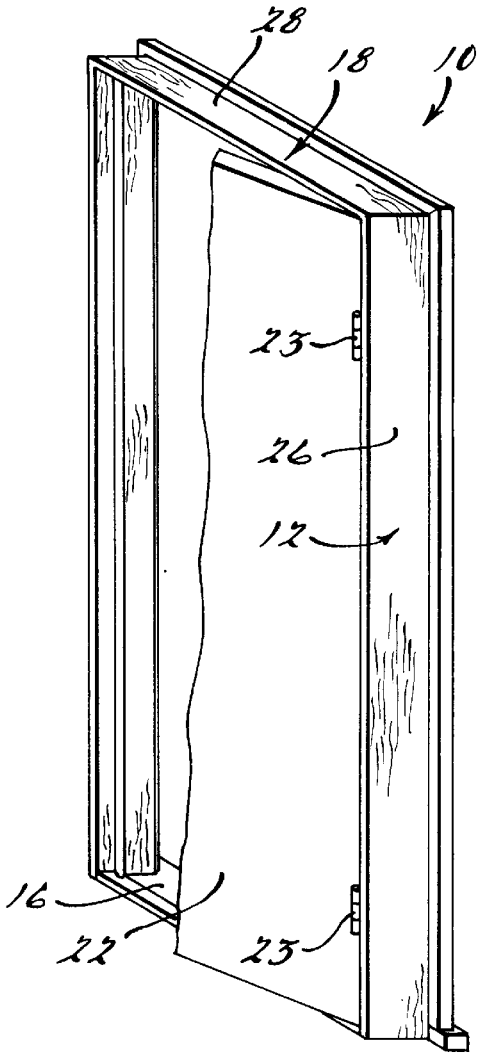
FIG. 2 is a rear perspective view of an exterior door frame in which a door jamb system according to a preferred embodiment of the present invention is implemented.

Referring to the drawings, a door frame according to a preferred embodiment of the present invention is shown generally at 10 in FIGS. 1 and 2. The door frame 10 consists of vertical jamb substrate members 12, 14 extending upwardly from a conventional door frame sill 16. A head jamb substrate member 18 extends across, and is integral with, the top edges of the vertical jamb substrate members 12, 14. When assembled in a conventional manner, the vertical jamb substrate members 12, 14, the sill 16 and the head jamb substrate member 18 define a door passageway 20 into which a door 22 attached to the frame by hinges 23 is selectively opened and closed. A door clad/jamb system, hereinafter referred to as a door jamb system, according to a preferred embodiment of the present invention and shown generally at 24, is mechanically interlocked with the jamb substrate members 12, 14, 18 as will be described below.

Figure 3:
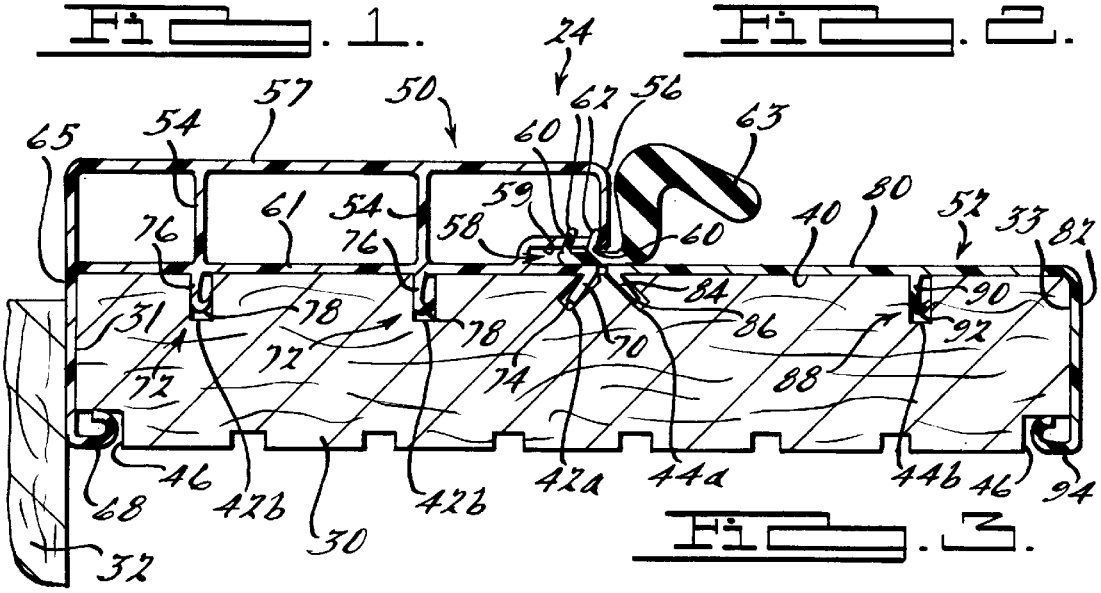
FIG. 3 is a sectional view, taken along line A—A in FIG. 1, of a door jamb system according to a first preferred embodiment of the present invention.

Referring to FIGS. 1–3, the vertical jamb substrate members 12, 14 and head jamb substrate member 18 each include an outer surface 26, 28, 30 integrally attached to a building doorway structure (not shown) in a conventional manner. Each of the jamb substrate members 12, 14, 18 also includes a first end surface, exemplified by the surface 31 of the vertical member 14 in FIG. 3, to which decorative molding 32 is attached to give the door frame system 10 an aesthetically pleasing appearance. Decorative molding (not shown) may also be added to a substrate member end surface, such as the end surface 33 of the vertical member 14, of the door as desired. Each of the jamb substrate members 12, 14, 18 also includes an inner surface, such as the inner surface 40 of the vertical member 14 shown in FIG. 3. The inner surfaces of the jamb substrate members 12, 14, 18 define slotted receptacles, such as those shown at 42*a*, 42*b* and 44*a*, 44*b* in FIG. 3. In addition, the end surfaces and outer surfaces of each of the jamb substrate members 12, 14, 18 define side channels, such as those shown at 46 in FIG. 3. The slotted receptacles 42*a*, 42*b* and 44*a*, 44*b* and the channels 46 allow the door jamb system 24 to be integrally interlocked to the door jamb substrate members 12, 14, 18 in a manner that will be described now in more detail.

Referring now in detail to FIG. 3, a cross-sectional view of the door jamb system 24 according to a preferred embodiment of the present invention is shown. As shown, the door jamb system 24 includes both a door stop 50 and a door jamb cladding 52. Preferably, the door stop 50 is formed of extruded rigid polyvinylchloride (PVC). However, it should be appreciated that the door stop may also be formed from other plastic-based products, such as cellular plastic, granular filled plastic, or fiber filled plastic or any other type of lightweight, rigid material capable of being attached to the frame substrate as described below. The stop has a continuous length matching that of the substrate member to which it is attached and includes structural support ribs 54. The stop also includes an abutment face 56, an outer wall 57 and a jamb channel 58. The jamb channel 58 is defined by an inner channel surface 59 defining jamb apertures 60, and a base wall 61. Retaining flanges 62 of a conventional weather strip 63 are inserted into the apertures 60 to retain the weather strip in a position adjacent the abutment face 56. The abutment face and the door stop provide a weather-tight seal between the door frame 10 and the door 22 when the door is closed into the frame 10. The stop also includes an anchor panel 65 including a channel engaging lip 68. Preferably, the jamb has an associated thickness of about 0.5 inches measured from the face of the base wall 61 to the face of the outer wall 57 and an associated depth of about 2.125 inches measured from the abutment face 56 to the anchor panel 65. However, these dimensions may vary according to the dimensions of the particular door frame and application.

Still referring to FIG. 3, the stop base wall 61 includes an angled flange 70 and deflection fingers 72 extending outwardly therefrom. Both the flange and the fingers may be continuous along the stop length or may be formed at predetermined spaced distances along the stop length as desired. The deflection flange 70 is preferably formed at a 45° angle with respect to the base wall surface. The deflection flange includes a curvilinear tip 74 which curves outwardly away from the inner surface of the stop for mechanically interlocking the flange 70 within the slotted receptacle 42*a* as will be described in detail below. The deflection fingers 72 each include a main body portion 76 and a hook portion 78 formed at approximately 45° with respect to the body portion. As with the curvilinear tip 74, the hook portions mechanically interlock the deflection fingers with the receptacles 42*b*.

Still referring to FIG. 3, the jamb cladding 52 is preferably formed from extruded rigid PVC. However, the jamb cladding may also be formed in lengths corresponding to the lengths of the substrate members or in shorter lengths for modular assembly from any of the materials used to form the jamb or of any other material exhibiting similar structural characteristics. The cladding 52 includes a flat planar inner panel 80 and a cover panel 82. The inner panel includes an angled deflection flange 84 having a curvilinear tip 86, and a deflection finger 88 having a main body portion 90 and a hook portion 92. The flange and fingers interlock the cladding 52 to the jamb substrate members 12, 14, 18 in a manner identical to that of the stop 50. The jamb cladding cover panel covers the portion of the substrate members that would otherwise be exposed to outdoor weather elements. The cover panel includes a cladding lip 94 the interlocks with the length of the substrate channel 46 to further interlock the cladding to the substrate member.

It should be appreciated at this point, that, although the stop 50 and the jamb cladding 52 are shown as separate components in FIG. 3, the stop and the jamb cladding 52 could be manufactured as a single integral component. Also, it should be appreciated that the weather strip 63 could also be integrally extruded along with the stop 50 to minimize assembly time and difficulty.

Referring to FIG. 3, assembly of the door frame system according to a preferred embodiment of the present invention will now be discussed. Each of the vertical jamb substrate members 12, 14 and the head member 18 are cut to predetermined desired lengths. The slotted receptacles 42*a*, 42*b*, and 44*a*, 44*b* are then formed at predetermined locations in each of the jamb substrate members 12, 14 and 18. Subsequently, the stop sections of the jamb system are inserted over the outer surface of the substrate members and are integrally connected through interlocking channel lip 68 with the channel 46, the flange 70 with the slotted receptacle 42*a*, and the fingers 72 with the slotted receptacles 42*b*. Similarly, the jamb cladding sections are inserted over the inner surfaces of the substrate members not covered by the stop such that the channel lip 94 interlocks with the channel 46, the flange 84 interlocks with the slotted receptacle 44*a*, and the finger 88 interlocks with the slotted receptacle 44*b*. Optionally, an adhesive of the type well known in the art may be extruded into the slotted receptacles and/or the channels before the flanges, the fingers, or the lips are interlocked therein to further secure the jamb and the jamb clad to the substrate. Subsequent to the stop 50 and the jamb cladding 52 being interlocked over the inner surfaces of the members 12, 14, 18, the vertical members are secured to the door sill 16. The head member 18 is then secured to top edges of the vertical members in a manner well known in the art. Molding 34 is then attached to a surface of the substrate as shown to form a finished door frame. Door hinges and latches may be installed before or after the door frame system is positioned within a building threshold as desired.

It should be appreciated at this point that both the stop 50 and the jamb cladding 52 of the present invention, by being mechanically interlocked with the door frame substrate members, form an outer shell over the jamb substrate members that increases the structural stability of the substrate members. Thus, less expensive and lower quality composite wood board products, such as oriented strand board, chip board, plywood, fiber board, finger jointed wood products, as well as extruded fiber and plastic products, quality wood, steel, aluminum and other conventional door frame products can be used to form the substrate members. In addition, the jamb system of the present invention protects underlying substrate members from weather elements such as moisture, ultraviolet light and temperature extremes, and thus increases the life of the door frame itself. In addition, the door jamb system of the present invention provides an aesthetically pleasing outer cover to the substrate members, thus allowing lower quality, and otherwise unsightly, materials to be used for the substrate members.

Figure 4:
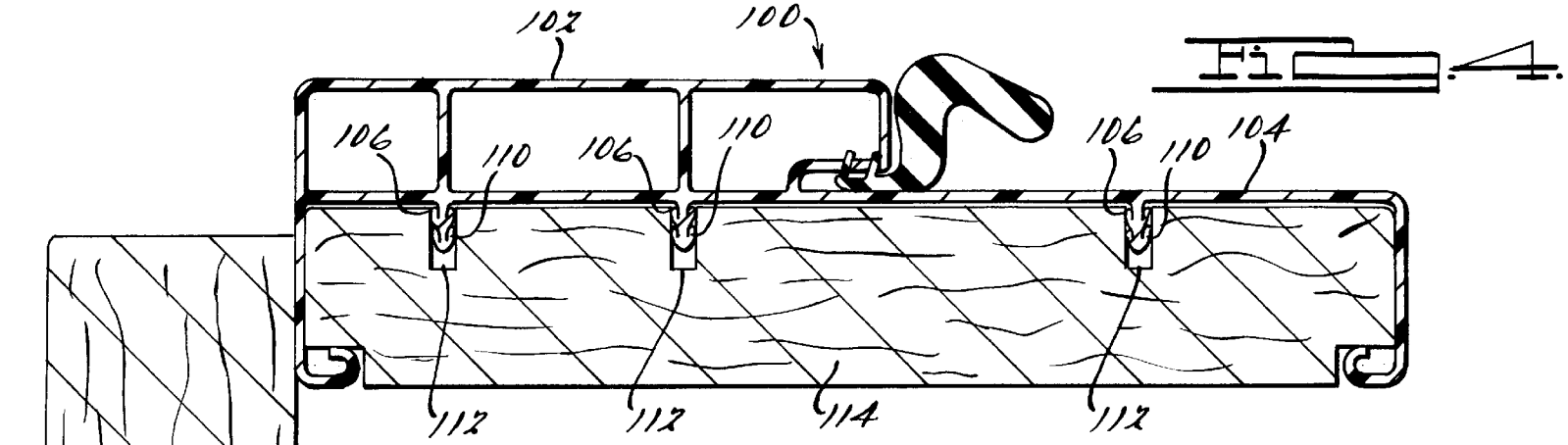
FIG. 4 is a sectional view, also taken along line A—A in FIG. 1, of a door jamb system according to a second preferred embodiment of the present invention.

Referring now to FIG. 4, a door jamb system according to a second preferred embodiment of the present invention is shown generally at 100. The door jamb system 100 is similar in structure and function to the system shown in FIG. 2. However, the stop 102 and the jamb cladding 104 are formed as a single integral component. In addition, the deflection fingers 106 all extend from the jamb and the jamb clad at substantially a 90° angle and include darts, indicated generally at 110, as opposed to deflection fingers or curvilinear tips extending from the flanges and deflection fingers shown in FIG. 3. The darts 110 mechanically interlock with slotted receptacles 112 found in the substrate member 114 to secure the single piece jamb system onto the door jamb substrate members. The single piece jamb system thus provides added structural stability and aesthetic qualities to the door frame similar to the door jamb system shown in FIG. 3.

Figure 5:
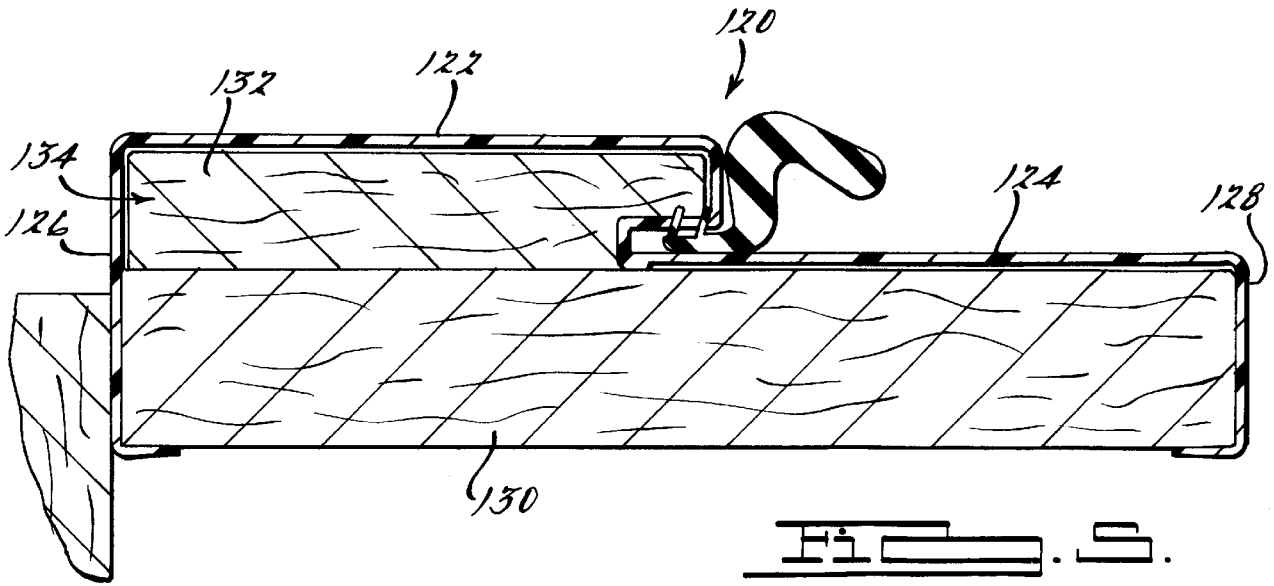
FIG. 5 is a sectional view, taken along line A—A of FIG. 1, of a door jamb system according to a third preferred embodiment of the present invention.

Referring to FIG. 5, a third preferred embodiment of the door jamb system is shown generally at 120. The door jamb system 120 includes a stop 122 and a jamb cladding 124 similar in structure and function to the earlier described first and second preferred embodiments. However, the subsystem 120 is a single integral unit having cover panels 126, 128 that extend around, and conform to, the end surfaces of substrate member 130. The substrate member 130 does not include edge channels, such as the channels 46 shown in FIG. 3. In addition, a solid material, such as wood 132, is inserted within the hollow, non-ribbed inner portion 134 of the stop along the length of the stop to provide added structural support to the stop.

Figure 6:
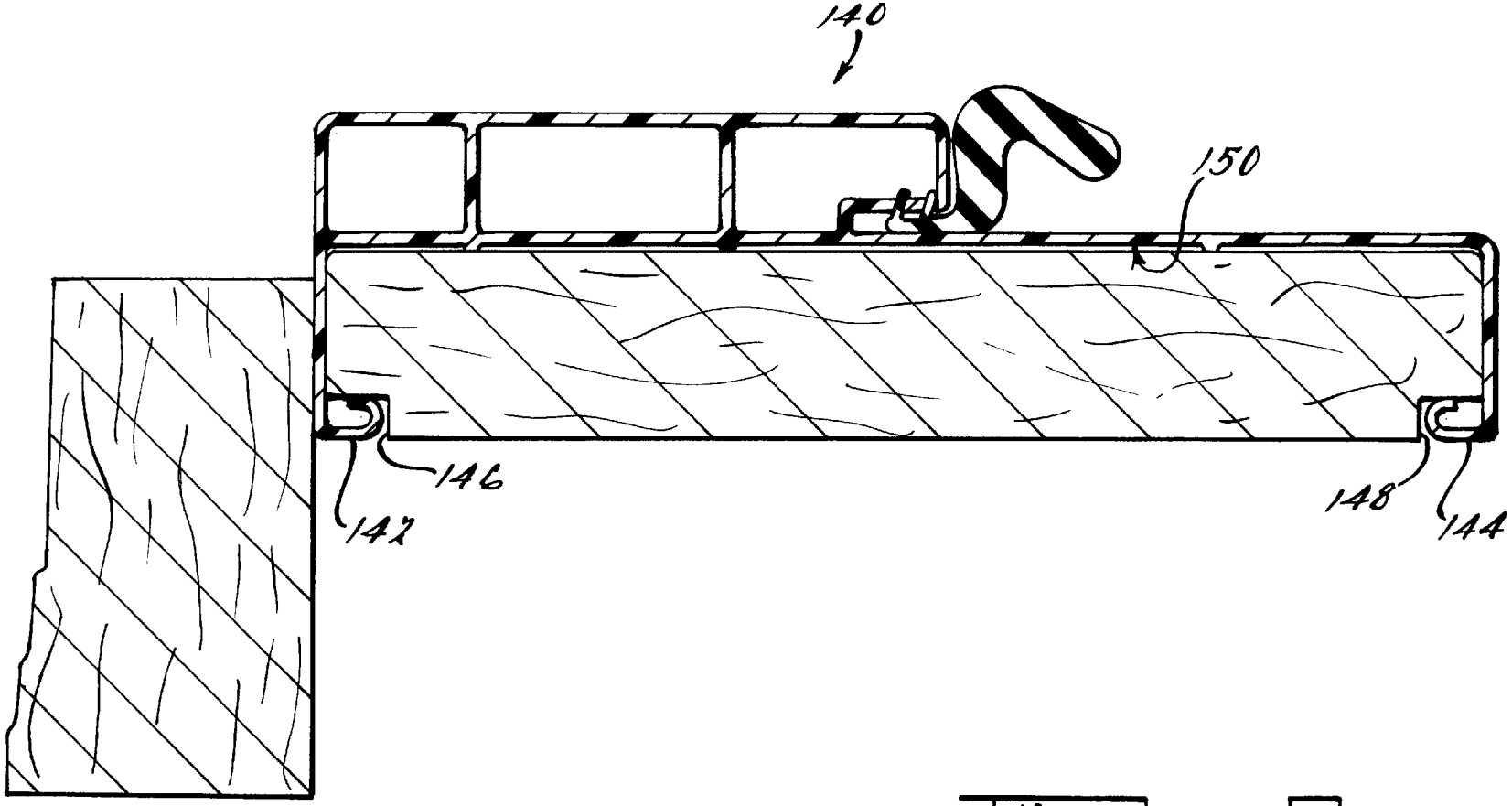
FIG. 6 is a sectional view, taken along line A—A of FIG. 1, of a door jamb system according to a fourth embodiment of the present invention.

Referring to FIG. 6, a door jamb system according to a fourth preferred embodiment of the present invention is shown generally at 140. The door jamb system 140 is similar to the door jamb system 100. The system 140 includes channel engaging lips 142, 144 for securing the system to the substrate channels 144, 146, similar to the channel-engaging lips 68, 94 shown in FIG. 3. However, the system 140 is further secured to the substrate by a structural adhesive 150 rather than fingers or flanges.

From the foregoing description, it should be appreciated that the jamb systems disclosed herein provide added stability to jamb substrate members used in the manufacture of door frames and provide an aesthetically pleasing outer shell over the substrate thereby permitting the use of materials that are less expensive than conventional quality wood products to be used for door jamb substrates. The door jamb systems according to preferred embodiments of the present invention also protect the door jamb substrate members from weather elements that would otherwise cause damage to finished wood door jamb substrates by inhibiting moisture ingress and by protecting the substrate from damage caused by such things as ultraviolet rays, wind and thermal cycling.

While the above description constitutes the preferred embodiment of the present invention, it should be appreciated that the invention may be modified without departing from the proper scope or fair meaning of the accompanying claims. Various other advantages of the present invention will become apparent to those skilled in the art after having the benefit of studying the foregoing text and drawings taken in conjunction with the following claims.

In the claims:

1. A door jamb system for a door frame having a door hingedly attached thereto, comprising:

A plurality of door jamb substrate members including first and second vertical members and a head member, each of said vertical members having end faces, an outer surface and an inner surface, said head member having a first end affixed to a top edge of said first vertical member, a second end affixed to a top edge of said second vertical member and an inner surface, said inner surfaces of said first and second vertical members and said head member defining a door passageway, said first and second vertical members and said head member further defining slotted receptacles in predetermined locations along said inner surfaces;

a door stop having an outer surface abutting said inner surfaces of said plurality of door jamb substrate members, and a stop face for abutting the door when the door is closed within said door passageway, said door stop outer surface including fingers extending therefrom that mechanically interlock with a first plurality of said slotted receptacles to secure said stop to said door jamb substrate members; and a jamb cladding that is permanently and directly affixed to said door jamb substrate members for covering exposed portions of said door jamb substrate members not covered by said stop, said jamb cladding including fingers extending therefrom for providing a mechanical interlock with a second plurality of said slotted receptacles to increase structural integrity of said plurality of door jamb substrate members and to protect said plurality of door jamb substrate members from exposure to outdoor weather conditions.

2. The door jamb system of claim 1, wherein said stop and said jamb cladding comprise a single integral component.

3. The door jamb system of claim 1, wherein said jamb cladding includes a cover portion that extends over one of said end faces of said door jamb substrate members and interlocks within a channel defined by said outer surfaces of said door jamb substrate members.

4. The door jamb system of claim 1, wherein said stop includes a cover portion that extends over one of said end faces of said door jamb substrate members and interlocks within a channel defined on said outer surfaces of said door jamb substrate members.

5. The door jamb system of claim 1, further comprising a weather strip affixed to said stop face of said stop to effect a weather-tight fit of the door within said jamb system when the door is closed into said jamb system.

6. The door jamb system of claim 1, wherein said weather strip is integrally extruded with said stop.

7. The door jamb system of claim 1, wherein said door stop fingers include a plurality of ribs to effect attachment of said stop to said plurality of door jamb substrate members.

8. The door jamb system of claim 1, wherein said stop fingers include a plurality of barbs to effect integral attachment of said stop to said plurality of door jamb substrate members.

9. The door jamb system of claim 1, wherein each of said plurality of door jamb substrate members is less than 1 inch in thickness.

10. The door jamb system of claim 1, wherein each of said plurality of door jamb substrate members is approximately 0.75 inches in thickness.

11. The door jamb system of claim 1, wherein said each of said plurality of door jamb substrate members is composed of a material selected from the group consisting of oriented strand board, chip board, plywood, fiber board, extruded fiber-filled material, and extruded granular-filled material.

12. The door jamb system of claim 1, wherein said door stop is composed of a material selected from the group consisting of an extruded thermoplastic polymer, a thermoplastic composite, and a thermoset composite resin-based material.

13. The door jamb system of claim 1, wherein said jamb cladding is composed of a material selected from the group consisting of an extruded thermoplastic polymer, a thermoplastic composite, and a thermoset composite resin-based material.

14. A door jamb system, comprising:

a door frame shell having an inner surface defining a door way entrance and including slotted receptacles therein;

a door stop including flanges extending therefrom, said door stop flanges being inserted into a first plurality of said slotted receptacles in integrally attach said door stop to said door frame shell; and a door jamb cladding that is permanently and directly affixed to said door frame shell for covering a portion of said door frame shell not covered by said stop, said door jamb cladding including cladding flanges extending therefrom for insertion into a second plurality of said slotted receptacles;

said door stop and said door jamb cladding forming a protective cover over said door frame shell that increases the structural integrity of said door frame shell and protects said door frame shell from degradation caused by damaging elements.

15. The door jamb system of claim 14, wherein said stop and said jamb cladding comprise a single integral component.

16. The door jamb system of claim 14, wherein said jamb cladding includes a cladding portion that extends over said door frame shell and interlocks within a channel defined by a surface of said door frame shell.

17. The door jamb system of claim 14, further comprising a weather strip affixed to said stop to effect a weather-tight fit of a door within said system when the door is closed into said jamb system.

18. The door jamb system of claim 14, wherein said weather strip is integrally extruded with said stop.

19. The door jamb system of claim 14, wherein said stop flanges include a plurality of ribs to effect attachment of said stop to said door frame shell.

20. The door jamb system of claim 14, wherein said stop flanges and said jamb cladding flange include a plurality of barbs to effect integral attachment of said stop to said door frame shell.

* * * * *

UNITED STATES PATENT AND TRADEMARK OFFICE

CERTIFICATE OF CORRECTION

PATENT NO. : 5,836,118
DATED : November 17, 1998
INVENTOR(S) : James D. Thornton et al

It is certified that error appears in the above-identified patent and that said Letters Patent is hereby corrected as shown below:

On the title page, Item [56] References Cited U.S. Patent Documents, insert the following patent documents:

| | | |
|---|---|---|
| 3,420,003 | 1/1969 | Cline |
| 3,520,085 | 7/1970 | Pond |
| 3,591,985 | 7/1971 | Coppins |
| 4,791,758 | 12/1988 | Bauer et al |
| 4,930,257 | 6/1990 | Windgassen |
| 5,058,323 | 10/1991 | Gerritsen |
| 5,182,880 | 2/1993 | Berge, Jr. et al |
| 5,345,722 | 9/1994 | McKann |
| 5,412,909 | 5/1995 | Wu |

Signed and Sealed this

Eighteenth Day of May, 1999

*Attest:*

*Attesting Officer*

Q. TODD DICKINSON

*Acting Commissioner of Patents and Trademarks*